United States Patent [19]

Hinata et al.

[11] 4,307,185

[45] Dec. 22, 1981

[54] PHOTOGRAPHIC SILVER HALIDE EMULSIONS

[75] Inventors: Masanao Hinata; Haruo Takei; Akira Sato; Atsuo Iwamoto; Jun Hayashi, all of Minami-ashigara, Japan

[73] Assignee: Fuji Photo Film Co., Ltd., Minami-ashigara, Japan

[21] Appl. No.: 720,291

[22] Filed: Sep. 3, 1976

[30] Foreign Application Priority Data

Sep. 9, 1975 [JP] Japan ..... 50/109366

[51] Int. Cl.[3] ..... G03C 1/14

[52] U.S. Cl. ..... 430/574; 430/588

[58] Field of Search ..... 96/124, 137; 430/574, 430/588

[56] References Cited

U.S. PATENT DOCUMENTS

| | | | |
|---|---|---|---|
| 3,463,640 | 8/1969 | Ficken et al. | 96/124 |
| 3,907,575 | 9/1975 | Shiba et al. | 96/124 |
| 3,922,170 | 11/1975 | Shiba et al. | 96/124 |
| 3,967,967 | 7/1976 | Hinata et al. | 96/124 |

*Primary Examiner*—J. Travis Brown

*Attorney, Agent, or Firm*—Sughrue, Mion, Zinn, Macpeak and Seas

[57] ABSTRACT

A silver halide photographic emulsion spectrally sensitized with a sensitizing combination of at least one sensitizing dye represented by General formula (I), at least one sensitizing dye represented by General formula (II) and at least one sensitizing dye represented by General formula (III):

(I)

$(X_1^-)_{m-1}$ wherein $Z^1$ and $Z^2$ each is the atoms necessary to form a benzothiazole nucleus or a benzoselenazole nucleus, $R^1$ and $R^2$ each is an alkyl group or a substituted alkyl group, wherein at least one of $R^1$ and $R^2$ is a substituted alkyl group having a sulfo group, $R^3$ is an alkyl group, $X_1$ is an acid anion and m is 1 or 2 and when the dye forms an intermolecular salt (betaine like structure), m is 1;

(II)

$(X_2^-)_{n-1}$ wherein $Z^3$ is a sulfur atom or a selenium atom, $Z^4$ is the atoms necessary to form a benzothiazole nucleus, a benzoselenazole nucleus, a naphtho[1,2-d]thiazole nucleus or a naphtho[1,2-d]selenazole nucleus, $R^4$ and $R^5$ each is an alkyl group or a substituted alkyl group, wherein at least one of $R^4$ and $R^5$ is a substituted alkyl group having a sulfo group, $R^6$ is an alkyl group, an aryl group, a furyl group or a thienyl group, $X_2$ is an acid anion and n is 1 or 2, and n is 1 when the dye forms an intermolecular salt (betaine like structure);

(III)

$(X_3^-)_{p-1}$ wherein $Z^5$ is the atomic group necessary to complete a naphthothiazole nucleus, $Z^6$ is the atomic group necessary to complete a benzimidazole nucleus, $R^7$ and $R^8$ each is an alkyl group or a substituted alkyl group, where at least one of $R^7$ and $R^8$ is a carboxyalkyl group or a substituted alkyl group having a sulfo group, $X_3$ is an acid anion, and p is 1 or 2, and p is 1 when the dye forms an intermolecular salt.

12 Claims, No Drawings

PHOTOGRAPHIC SILVER HALIDE EMULSIONS

BACKGROUND OF THE INVENTION

1. Field of the Invention

The present invention relates to a photograhic silver halide emulsion which is spectrally sensitized with a spectral sensitizing dye, more particularly, to a silver halide photographic emulsion which is spectrally sensitized in the red wavelength region.

2. Description of the Prior Art

As one technique of making light-sensitive photographic materials, it is well known that the light-sensitive wavelength region is further widened to a longer one by incorporating certain cyanine dyes into a silver halide photographic emulsion. This is called spectral sensitization.

However, spectral sensitizing effects are influenced by photographic additives such as a stabilizing agent, an anti-fogging agent, a coating aid, a precipitating agent, color image forming couplers, etc., which are often added to the emulsion in combination therewith. Among these, particularly, color image forming couplers have a large influence upon spectral sensitization, since the couplers are used in a large amount.

It is required that spectral sensitizing dyes used for spectral sensitization of photographic silver halide emulsions have no undesirable interaction with other photographic additives and have stable photographic properties during storage of light-sensitive materials.

Further, such spectral sensitizing dyes are required to cause no residual color in processed light-sensitive materials. It is particularly required that there be no residual color after rapid processing, usually carried out for from several ten seconds to several hundred seconds.

On the other hand, various measures have been suggested to obtain superior color reproduction in color light-sensitive materials. One technique which has recently been carried out to obtain excellent color reproduction by using only one kind of light-sensitive material for various light sources (for example, sun light, tungsten light, an electronic flash, a fluorescent light or a combination thereof) is disclosed in Japanese Patent Publication No. 6207/74, where the maximum spectral wavelength of each of various color light-sensitive layers is set to minimize changes in color hue resulting from the use of different light sources; it is also desirable that the maximum spectral wavelength of the red-sensitive emulsion layer be at 610 nm (±5 nm). However, where the maximum spectral wavelength of the red-sensitive layer is shortened as above, sensitivity, in general, is lowered. For instance, where a light-sensitive material having maximum sensitization at 610 nm is employed, it is difficult to obtain the same red sensitivity as produced by a light-sensitive material having maximum sensitization at 630 nm or 640 nm.

In order to obtain the same sensitivity, it is required that the grain size be enlarged to raise the sensitivity of the original emulsion. Enlarging the grain size brings about disadvantages such as a decrease of image sharpness and so on. Reproduction of flesh tones, which is important in color photography, has a close relationship to the maximum spectral wavelength of the red-sensitive layer. It is undesirable to shorten the wavelength and it is desirable that the maximum spectral wavelength be longer than 625 nm.

SUMMARY OF THE INVENTION

A first object of the present invention is to provide a silver halide photographic emulsion having high red sensitivity suitable for forming the red-sensitive layer(s) of color light-sensitive materials having excellent color reproduction and high sensitivity.

A second object of the present invention is to provide a spectrally sensitized silver halide photographic emulsion whose red sensitivity is not or only slightly decreased where a cyan color-forming coupler is incorporated in the emulsion.

A third object of the present invention is to provide a spectrally sensitized silver halide photographic emulsion providing less residual coloring after processing and which is suitable for rapid development processing.

A fourth object of the present invention is to provide a spectrally sensitized silver halide photographic emulsion whose sensitivity is hardly decreased with the passage of time.

The above various objects can be attained by the following method, that is, the objects of the invention can be attained by incorporating in a silver halide photographic emulsion at least one sensitizing dye represented by General formula (I), at least one sensitizing dye represented by General formula (II) and at least one sensitizing dye represented by General formula (III), in combination, in an amount necessary to spectrally sensitize a silver halide photographic emulsion.

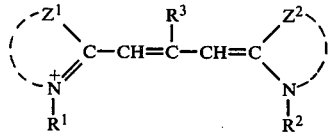

(I)

$(X_1^-)_{m-1}$ wherein $Z^1$ and $Z^2$ each is the atoms necessary to form a benzothiazole nucleus or a benzoselenazole nucleus, $R^1$ and $R^2$ each is an alkyl group or a substituted alkyl group, wherein at least one of $R^1$ and $R^2$ is a substituted alkyl group having a sulfo group, $R^3$ is an alkyl group, $X_1$ is an acid anion as is customarily used in the cyanine art and m is 1 or 2, and when the dye forms an intermolecular salt (betaine like structure), m is 1.

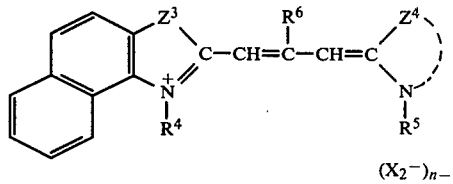

(II)

$(X_2^-)_{n-1}$ wherein $Z^3$ is a sulfur atom or a selenium atom, $Z^4$ is the atoms necessary to form a benzothiazole nucleus, a benzoselenazole nucleus, a naphtho[1,2-d]thiazole nucleus or naphtho[1,2-d]-selenazole nucleus, $R^4$ and $R^5$ each is an alkyl group or a substituted alkyl group, wherein at least one of $R^4$ and $R^5$ is a substituted alkyl group having a sulfo group, $R^6$ is an alkyl group, an aryl group, a furyl group or a thienyl group, $X_2$ is an acid anion as is customarily used in the cyanine dye art, and n is 1 or 2, and n is 1 when the dye forms an intermolecular salt (betaine like structure).

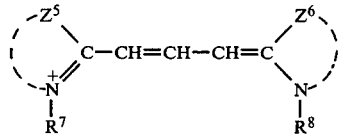

(III)

$(X_3^-)_{p-1}$ wherein $Z^5$ is an atomic group necessary to complete a naphthothiazole nucleus, $Z^6$ is an atomic group necessary to complete a benzimidazole nucleus, $R^7$ and $R^8$ each is an alkyl group or a substituted alkyl group, wherein at least one of $R^7$ and $R^8$ is a carboxyalkyl group or a substituted alkyl group having a sulfo group, $X_3$ is an acid anion as is customarily used in the cyanine dye art, and p 1 or 2, and p is 1 when the dye forms an intermolecular salt.

DESCRIPTION OF THE PREFERRED EMBODIMENTS

In the above general formulae, when $R^1$ and $R^2$ are alkyl groups, they preferably have 1 to 6 carbon atoms, even more preferably 1 to 3 carbon atoms, and when $R^1$ or $R^2$ are substituted alkyl groups, preferred substituents are a sulfo group, a carboxy group, a hydroxy group, a phenyl group, a carbamoyl group or an alkoxy group (e.g., a methoxy group or an ethoxy group), and more preferred substituents are a sulfo group or a carboxy group, in which case the alkyl moiety which is substituted preferably has 1 to 6 carbon atoms, even more preferably 1 to 4 carbon atoms.

Further, when $R^3$ is an alkyl group, it preferably has 1 to 6 carbon atoms, even more preferably 1 to 3 carbon atoms.

$R^4$ and $R^5$, when alkyl groups, preferably have 1 to 6 carbon atoms, even more preferably 1 to 3 carbon atoms, and when $R^4$ and $R^5$ are substituted alkyl groups, the alkyl moiety preferably has 1 to 6 carbon atoms, even more preferably 1 to 4 carbon atoms, and preferred substituents are a sulfo group, a carboxy group, a hydroxy group, a phenyl group, a carbamoyl group or an alkoxy group (e.g., a methoxy group or an ethoxy group), and more preferred substituents are a sulfo group or a carboxy group.

Further, when $R^6$ is an alkyl group, it preferably has 1 to 6 carbon atoms, even more preferably 1 to 3 carbon atoms, and when $R^6$ is an aryl group, it preferably has 6 to 10 carbon atoms, more preferably 6 carbon atoms.

When $R^7$ or $R^8$ are alkyl groups, they preferably have 1 to 6 carbon atoms, more preferably 1 to 3 carbon atoms, and when a substituted alkyl group the alkyl moiety preferably has 1 to 6 carbon atoms, more preferably 1 to 4 carbon atoms, and preferred substituents include a sulfo group, a carboxy group, a hydroxy group, a phenyl group, a carbamoyl group, or an alkoxy group (e.g., a methoxy group or an ethoxy group), and more preferred substituents are a sulfo group, a carboxy group, a sulfopropoxy group or a sulfopropoxyethoxy group.

In the above formulae, specific examples of the substituents are as follows.

Specific examples of benzothiazole nuclei or benzoselenazole nuclei which are respectively formed by $Z^1$ and $Z^2$ are benzothiazole, 5-chlorobenzothiazole, 5-bromobenzothiazole, 5-methylbenzothiazole, 5-methoxybenzothiazole, 5-ethoxybenzothizole, 6-methylbenzothiazole, 6-chlorobenzothiazole, 5-carboxybenzothiazole, 5-acetylbenzothiazole, 5-methoxycarbonylbenzothiazole, 5-hydroxybenzothiazole, 5-trifluoromethylbenzothiazole, 5-cyanobenzothiazole, 5,6-dimethylbenzothiazole, 5-acetylaminobenzothiazole, 6-methoxybenzothiazole, 5-ethoxy-6-methylbenzothiazole, 5,6-dimethoxybenzothiazole, 5-hydroxy-6-methylbenzothiazole, 5,6-dichlorobenzothiazole and 5-phenylbenzothiazole; benzoselenazole, 5-chlorobenzoselenazole, 5-bromobenzoselenazole, 5-methylbenzoselenazole, 5-methoxybenzoselenazole, 5-hydroxybenzoselenazole and 5,6-dimethylbenzoselenazole.

Nuclei completed by $Z^4$ are a naphtho[1,2-d]thiazole nucleus or a naphtho[1,2-d]selenazole nucleus in addition to a benzothiazole nucleus and a benzoselenazole nucleus as defined by $Z^1$ and $Z^2$.

Groups represented by $R^1$ and $R^2$ are an alkyl group, e.g., a methyl group, ethyl group or propyl group, and a substituted alkyl group, e.g., a substituted alkyl group having a sulfo group such as a sulfoalkyl group (e.g., a 2-sulfoethyl group, 3-sulfopropyl group, 3-sulfobutyl group, 4-sulfobutyl group, 2-hydroxy-3-sulfopropyl group, etc.), sulfoalkoxyalkyl group (e.g., a 2-(3-sulfopropoxy)ethyl group, 2-[2-(3-sulfopropoxy)ethoxy]ethyl group, etc.), a carboxyalkyl group (e.g., a 2-carboxyethyl group, 4-carboxybutyl group, carboxymethyl group, etc.), a hydroxyalkyl group (e.g., a 2-hydroxyethyl group, 3-hydroxypropyl group, 4-hydroxybutyl group, etc.), an allyl group, a benzyl group, etc.

$R^3$ is an alkyl group, e.g., a methyl group, ethyl group, propyl group, etc.

$R^6$ is a phenyl group, a furyl group or a thienyl group, in addition to an alkyl group as defined by $R^3$.

Specific examples of naphthothiazole nuclei completed by $Z^5$ are a naphtho[1,2-d]thiazole nucleus, a naphtho[2,1-d]thiazole nucleus, and a naphtho[2,3-d]thiazole nucleus.

Examples of benzimidazole nuclei completed by $Z^6$ are a benzimidazole nucleus, a 3-ethylbenzimidazole nucleus, a 3-ethyl- 5-chlorobenzimidazole nucleus, a 3-ethyl-5-cyanobenzimidazole nuleus, a 3-ethyl-5-trifluoromethylbenzimidazole nucleus, a 3-ethyl-5-butoxycarbonylbenzimidazole nucleus, a 3-ethyl-5,6-dichlorobenzimidazole nucleus, a 3-ethyl-5-chloro-6-bromobenzimidazole nucleus, a 3-(2-methoxycarbonylethyl)-5,6-dichlorobenzimidazole nucleus, and a 3-(2-acetoxyethyl)-5,6-dichlorobenzimidazole nucleus.

$R^4$ and $R^5$, and $R^7$ and $R^8$ have the same definition as $R^1$ and $R^2$, and $R^9$ is an alkyl group such as a methyl group, ethyl group, propyl group or vinylmethyl group, etc.

$X_1$, $X_2$ and $X_3$ each is an acidic anion such as an iodide ion, bromide ion, chloride ion, p-toluenesulfonic acid ion, benzenesulfonic acid ion, sulfuric acid ion, perchlorate ion or thiocyanate ion, as are commonly used to form cyanine dye salts.

Among those compounds represented by General formulae (I), (II) and (III), compounds represented by the following General formulae (IA), (IIA) and (IIIA) are particularly useful in the present invention.

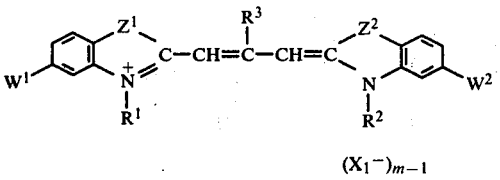

(IA)

wherein $Z^1$ and $Z^2$ each is a sulfur atom or a selenium atom, $W^1$ and $W^2$ each is a hydrogen atom, a halogen atom, an alkyl group, an alkoxy group, a hydroxy group, a phenyl group, an acyl group or an alkoxycarbonyl group, and $R^1$, $R^2$, $R^3$, $X_1$ and m have the same definition as $R^1$, $R^2$, $R^3$, $X_1$ and m in the foregoing General formula (I). When $W^1$ or $W^2$ are alkyl groups, they preferably have 1 to 4 carbon atoms, more preferably 1 to 2 carbon atoms, with the same carbon atom range applying to these moieties when they are an alkoxy group, whereas in the case when these moieties are an alkoxycarbonyl group, the alkoxy moiety preferably has 1 to 6 carbon atoms, even more preferably 1 to 3 carbon atoms. When $W^1$ or $W^2$ is an acyl group, it is preferably an acetyl group, a propionyl group, a mesyl group or a benzoyl group, most preferably an acetyl group or a propionyl group.

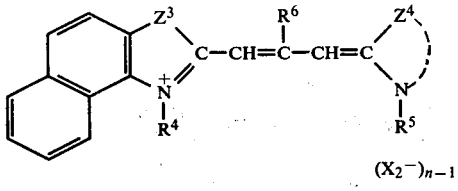

(IIA)

wherein $Z^3$ is a sulfur atom or a selenium atom, $Z^4$ is a benzoselenazole nucleus or a benzothiazole nucleus (unsubstituted or substituted at the 5-position with a halogen atom), an alkyl group, preferably having 1 to 4 carbon atoms, more preferably 1 to 2 carbon atoms, an alkoxy group, preferably having 1 to 4 carbon atoms, more preferably 1 to 2 carbon atoms, or a hydroxy group, or an atomic group necessary to complete an unsubstituted naphtho[1,2-d]thiazole nucleus or a naphtho[1,2-d]selenazole nucleus, and $R^4$, $R^5$, $R^6$, $X_2$ and n have the same definition as $R^4$, $R^5$, $R^6$, $X_2$ and n in the foregoing General formula (II).

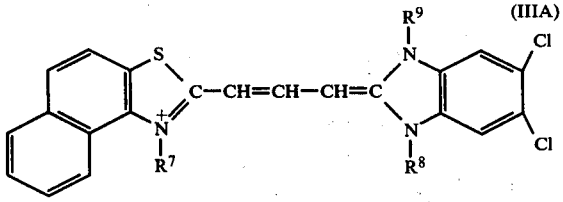

(IIIA)

wherein $R^7$ and $R^8$ each is an alkyl group or a substituted alkyl group, where preferred alkyl groups and substituted alkyl groups for $R^7$ and $R^8$ are as earlier defined for General formula (III), and at least one of these is a carboxyalkyl group, a sulfoalkyl group or a sulfoalkoxyalkyl group. When a carboxyalkyl group, the alkyl moiety preferably has 1 to 6 carbon atoms, more preferably 1 to 4 carbon atoms, with the same applying to the alkyl moiety of the sulfoalkyl group. On the other hand, when sulfoalkoxyalkyl, the alkoxy moiety preferably has 2 to 6 carbon atoms, more preferably 2 to 5 carbon atoms, and the alkyl moiety thereof preferably has 2 to 4 carbon atoms, more preferably 2 carbon atoms. $R^9$ is an alkyl group having not more than 3 carbon atoms, and $X_3$ and p have the same definition as that of $X_3$ and p in the above mentioned General formula (III).

Specific examples of sensitizing dyes used in the present invention are shown below, but the present invention should not be limited to these compounds.

Specific examples of dyes represented by General formula (I).

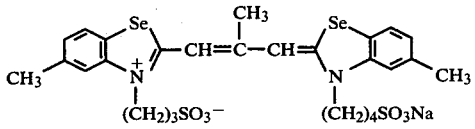

I-1

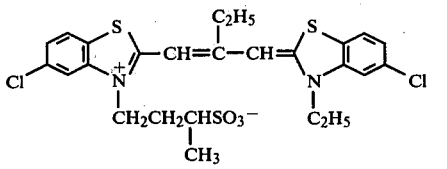

I-2

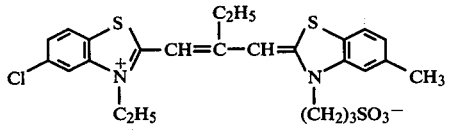

I-3

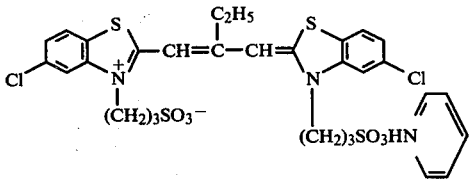

I-4

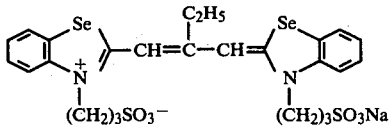

I-5

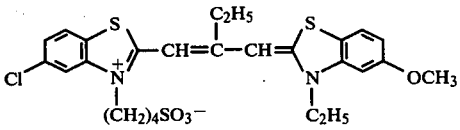

I-6

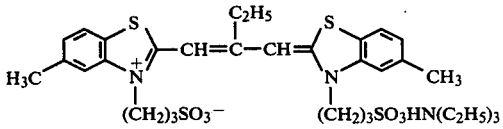

I-7

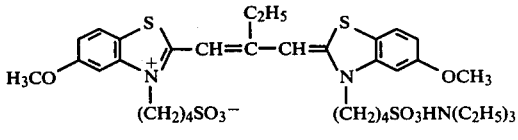

I-8

-continued
I-9
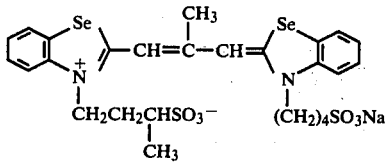
I-10
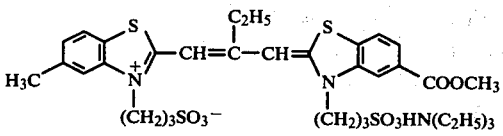
I-11
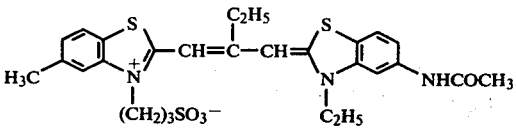
I-12
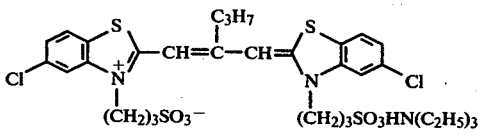
I-13
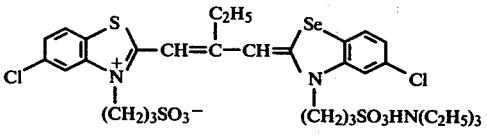
I-14
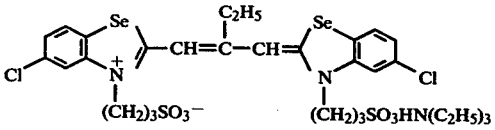
I-15
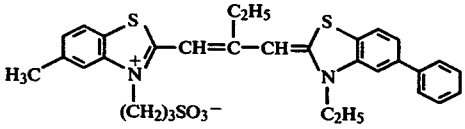
I-16
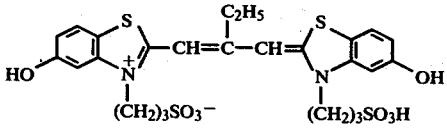
Specific examples of dyes represented by General formula (II).
II-1
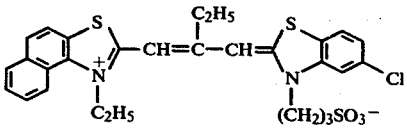
II-2
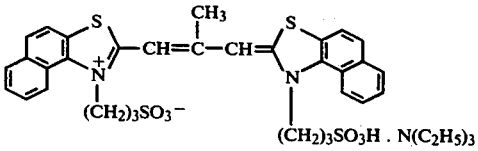
-continued
II-3
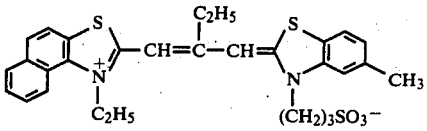
II-4
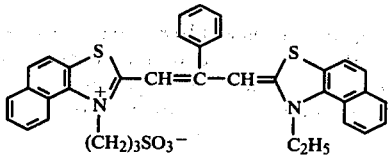
II-5
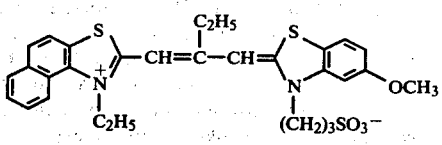
II-6
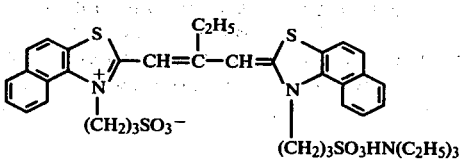
II-7
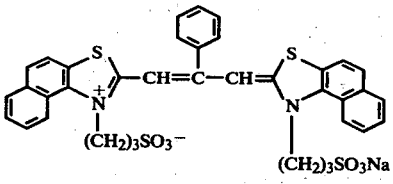
II-8
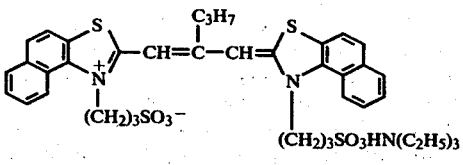
II-9
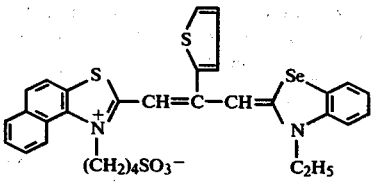
II-10
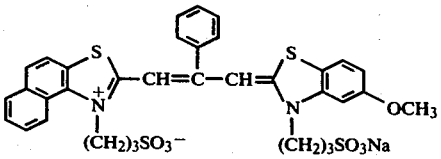
II-11
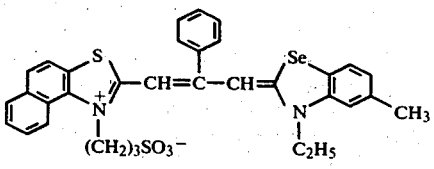

-continued

II-12

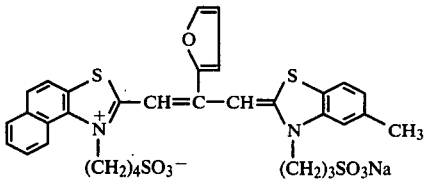

II-13

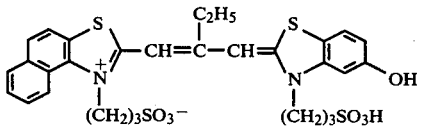

Specific examples of dyes represented by General formula (III).

III-1

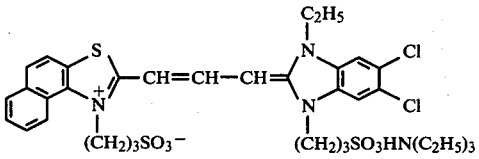

III-2

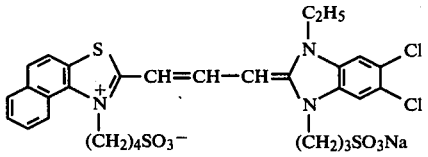

III-3

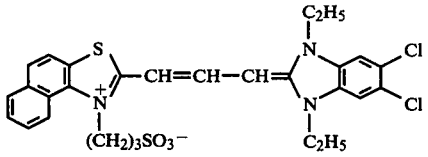

III-4

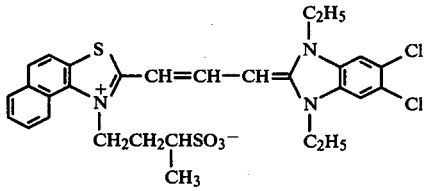

III-5

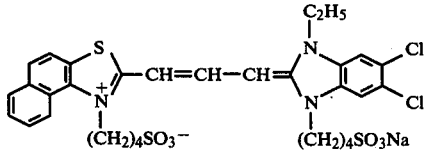

III-6

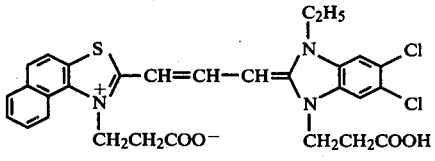

III-7

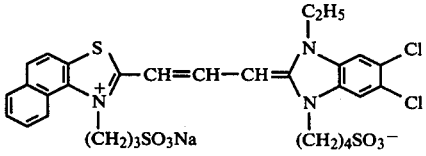

-continued

III-8

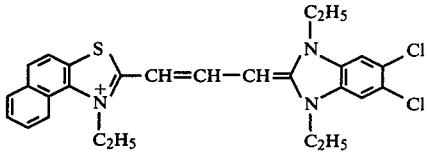

I⁻

Particularly preferred compounds in the present invention are those wherein in General formula (IA) $R^3$ is a methyl group, $W^1$ and $W^2$ each is a hydrogen atom, an alkyl group, preferably having 1 to 4 carbon atoms, more preferably 1 to 2 carbon atoms, an alkoxy group, preferably having 1 to 4 carbon atoms, more preferably 1 to 2 carbon atoms, or a halogen atom, $Z^1$ and $Z^2$ each is a selenium atom, and those wherein $R^3$ is an ethyl group, $W^1$ and $W^2$ each is a hydrogen atom, a halogen atom, an alkyl group, preferably having 1 to 4 carbon atoms, more preferably 1 to 2 carbon atoms, an acyl group, preferably an acetyl group, propionyl group or mesyl group, most preferably an acetyl group, or an alkoxycarbonyl group, wherein the alkoxy moiety preferably has 1 to 6 carbon atoms, more preferably 1 to 3 carbon atoms, and $Z^1$ and $Z^2$ each is a sulfur atom or a selenium atom.

Those compounds are preferred in General formula (IIA) wherein $Z^4$ forms a naphtho[1,2-d]thiazole ring nucleus, and $R^6$ is a methyl group, an ethyl group or a phenyl group.

Those compounds are preferred in General formula (IIIA) wherein $R^9$ is an ethyl group.

Compounds represented by each of General formulae (I), (II) and (III) are included in an amount of from about $1\times\ ^{-6}$ mol to about $5\times10^{-3}$ mol, preferably from $3\times10^{-6}$ to $2.5\times10^{-3}$ mol, and particularly preferably from $1\times10^{-5}$ to $1\times10^{-3}$ mol, per mol of silver halide in the silver halide photographic emulsion. The ratio of the amount of each class of dyes employed, that is, (amount of the dye(s) represented by General formula (I)): (amount of the dye(s) represented by General formula (II)): (amount of the dye(s) represented by General formula (III)) is particularly important in the present invention. The molar ratio is (1–20):1:(2–20), and that of (10–16):1:(4–10) is particularly preferred.

As the silver halide used in the silver halide photographic emulsion of the present invention, any of silver bromide, silver iodobromide, silver iodochlorobromide, silver chlorobromide and silver chloride can be used.

The average grain size of the silver halide grains in the photographic emulsion is not limited, but is preferably not more than 3μ and preferably not less than about 0.05μ. In this specification, the term "average grain size" is determined by the projected area method in which the size of a silver halide grain is the grain diameter where the shape of the grain is globular or similar thereto or the edge length where the shape of the grain is cubic. The grain size distribution can be either wide or narrow.

vention can be prepared by the methods as disclosed in E. J. Wall, *Photographic Emulsions* (American Photographic Publishing Co. (1929)), P. Glafkides, *Photographic Chemistry* (English Edition, Paul Montel Co. (1958)), V. L. Zelikman, et al., *Making and Coating Photographic Emulsions* (The Focal Press Co. (1964)), etc. That is, a neutral method, an acidic method or an ammoniacal method can be used. A single jet method or a double jet method can be employed as the method for reacting a soluble silver salt with a soluble halogen salt. Further, a method for forming silver halide grains in amounts in excess of the silver ions, called a "reverse mixing method", can be employed, and a method for forming silver halide grains keeping the pAg of the liquid phase in which silver halide is formed constant can also be employed. This method is called a controllable double jet method in the art. Silver halide emulsions having a homogeneous crystal form and grain size can be obtained by this method. Two or more kinds of silver halide emulsions separately prepared can be mixed, if desired.

Conventional methods can be applied to chemically sensitize the above emulsion, if desired. That is, a sulfur sensitizing method using compounds which are capable of reacting with silver ions, such as a thiosulfate, an allylisothiocyanate, an organic compound having the structure N—CS—NH— (e.g., allylthiourea, triethylthiourea, etc.), or rhodanines and sulfur sensitizing using active gelatin; a reduction sensitizing method using reducible compounds such as polyamines, hydrazine derivatives, iminoaminomethanesulfinic acid, a stannous salt, a silane compound, etc.; a gold sensitizing method using a gold complex salt as disclosed in U.S. Pat. No. 2,399,083 and a gold thiosulfuric complex, etc.; and a sensitizing method using salts of noble metals belonging to group VIII in the Periodic Table such as platinum, iridium, palladium, rhodium and ruthenium as disclosed in U.S. Pat. Nos. 2,448,060 and 2,540,086 can be employed, individually or in combination.

Various compounds can be incorporated in the photographic emulsion of the present invention during the preparation of the photographic materials in order to prevent fog caused during storage or photographic processing or to stabilize the photographic properties. That is, various compounds known as stabilizing agents and anti-fogging agents such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, etc.); mercaptopyrimidines; mercaptotriazines; thioketone compounds such as oxazolinethione; azaindenes such as triazaindenes, tetrazaindenes and pentazaindenes; benzenethiosulfonic acid; benzenesulfinic acid; benzenesulfonic acid amide; etc., can be added, if desired.

Organic or inorganic hardening agents can be added to the photographic emulsion of the present invention, if desired. As organic hardening agents, there are aldehydes (e.g., formaldehyde, glyoxal and glutaraldehyde), N-methylol compounds (e.g., N,N'-dimethylol urea, methylolhydantoin, etc.), dioxane derivatives (e.g., dihydroxydioxane and derivatives thereof), compounds having epoxy groups (e.g., 1,3-bis-(2',3'-epoxypropoxy)propane), compounds having a reactive halogen (e.g., 2,4-dichloro-6-hydroxy-1,3,5-triazine), mucohalogenic acids (e.g., mucochloric acid, mucobromic acid or derivatives thereof), bismethanesulfonic acid esters, sulfonyl compounds (e.g., bisbenzenesulfonylchloride), divinylsulfones, compounds having a reactive olefin bond, compounds having a divinylketone or acryloyl group, aziridine compounds, alkylenebismaleimides, isocyanates, carbodiimides, dialdehyde starch and other high molecular hardening agents. As inorganic hardening agents there are chromium salts (e.g., chromium alum, chromium acetate) and zirconium salts (e.g., zirconium sulfate). These can be used individually or in combination. Precursors of the hardening agents such as sulfite-aldehyde addition products and methylolhydantoin addition products can also be used. Specific examples of useful hardening agents are disclosed in U.S. Pat. Nos. 1,870,354, 2,080,019, 2,579,801, 2,725,295, 2,726,162, 2,983,611, 2,992,109, 3,017,280, 3,047,394, 3,057,723, 3,103,437, 3,288,775, 3,325,287, 3,362,827 and 3,380,829, British Pat. Nos. 676,628, 825,544, 994,869 and 1,167,207, German Pat. Nos. 872,153 and 1,090,427 and Japanese Patent Publications Nos. 7133/59, 1872/71 and 38713/71.

Cyan color image forming couplers, that is, compounds which form cyan dyes by reacting with an oxidation product of an aromatic amine (generally a primary amine) in a developing solution can be incorporated in the photographic emulsion of the present invention. These compounds are hereinafter called couplers. It is desirable that the couplers be non-diffusible since they have hydrophobic groups which are commonly called ballast groups in their molecule. That is, it is desired that the couplers not diffuse into another layer during the steps from manufacturing light-sensitive materials to color forming development. The couplers can be two-equivalent or four-equivalent. Couplers can be colored couplers which serve to adjust color or can be couplers (DIR coupler) which release developing restrainers.

Phenol derivatives and naphthol derivatives can be used as the cyan color image forming couplers. Specific examples thereof are disclosed in U.S. Pat. Nos. 2,369,924, 2,434,272, 2,474,293, 2,600,788, 2,698,794, 2,706,684, 2,895,826, 3,034,892, 3,214,437, 3,253,924, 3,311,476, 3,386,830, 3,458,315, 3,560,212, 3,582,322, 3,583,971 and 3,591,383, German Patent Applications Nos. 2,163,811 and 2,414,006 and Japanese Patent Publications Nos. 6031/65 and 28836/70.

As colored couplers which form cyan color images, those disclosed in Japanese Patent Publications Nos. 22335/63, 20591/66, 11304/67, 32461/69 and in U.S. Pat. Nos. 3,034,892 and 3,386,830 can be used.

DIR couplers are compounds which have, as coupling releasable groups, residual groups which form development restrainers. For instance, those as disclosed in U.S. Pat. Nos. 3,148,062, 3,227,554, 3,617,291, 3,622,328, 3,770,436 and 3,790,384 and German Patent Application (OLS) No. 2,414,006 can be used.

In the hydrophilic colloid layer of light-sensitive materials prepared using the emulsion of the present invention there can be incorporated compounds which prevent, in the case of color light-sensitive materials, color fog and color mixing between layers, such as a hydroquinone substituted with at least one of an alkyl group, an aryl group, and a sulfo group, high molecular weight compounds having a hydroquinone residual group, catechol derivatives, aminophenol derivatives, gallic acid derivatives and ascorbic acids, in the form of a dispersion if they are water insoluble. Specific examples of such compounds are disclosed in U.S. Pat. Nos. 2,336,327, 2,360,290, 2,384,658, 2,403,721, 2,728,659, 2,732,300, 2,735,765, 2,418,613, 2,675,314, 2,710,801, 2,816,028 and 3,457,079 and in French Pat. No. 885,982.

In order to introduce these compounds into hydrophilic colloid layers or to introduce couplers into photographic emulsions, there is a method which comprises dispersing these compounds into a hydrophilic colloid together with an organic solvent having a high boiling point, such as fatty esters, aromatic carboxylic alkyl esters, aromatic phosphoric esters and aromatic ethers, and a method which comprises adding these compounds in the form of an alkaline aqueous solution to a hydrophilic colloid.

Commonly used exposure conditions are employed for obtaining photographic images. That is, various known sources can be used, e.g., natural light (sunlight), a tungsten lamp, a fluorescent light, a mercury lamp, a xenon arc lamp, a carbon arc lamp, a xenon flash lamp and a cathode ray tube flying spot. The exposure time is generally from 1/1,000 to 1 second in the case of a camera, but exposure times shorter than 1/1,000 second, for example, from $1/10^4$ to $1/10^6$ second using a xenon flash lamp or a cathode ray tube, and exposure times longer than 1 second, are also applicable. The spectral composition of the light employed for exposure can be adjusted by a color filter, if desired or necessary. Laser light can also be used as the exposure source.

Conventional photographic processings for light-sensitive materials can be used in this invention. The conventional processing solutions can also be used. The processing temperature is commonly from 18° C. to 50° C., but temperatures below 18° C. and above 50° C. can also be used.

Any one of the developing processing, a black-and-white photographic processing (to form silver images) or a color photographic processing (to form dye images) can be used.

The developing solutions employed for a black-and-white photographic processing are conventional and include conventionally used components in conventional amounts. Exemplary developing agents are dihydroxybenzenes (e.g., hydroquinone, chlorohydroquinone, methylhydroquinone), 3-pyrazolidones (e.g., 1-phenyl-3-pyrazolidone, 1-phenyl-4-methyl-3-pyrazolidone), aminophenols (e.g., o-aminophenol, p-aminophenol, N-methyl-p-aminophenol, 2,4-diaminophenol), pyrogallol, ascorbic acids, 1-aryl-3-pyrazolines (e.g., 1-(p-hydroxyphenyl)-3-aminopyrazoline and 1-(p-methylaminophenyl)-3-aminopyrazoline, which can be used individually or in combination.

The developing solution can include, if desired or necessary, preservatives (e.g., a sulfite, bisulfite, ascorbic acid, etc.), alkali agents (e.g., hydroxides, carbonates, etc.), pH buffer agents (e.g., carbonates, borates, boric acid, acetic acid, citric acid, alkanolamines, etc.), solubilizers (e.g., polyethylene glycols and esters therof, alkanolamines, etc.), sensitizing agents (e.g., nonionic surfactants containing polyoxyethylene chains, quaternary ammonium compounds, etc.), surface active agents, fog preventing agents (e.g., halogeno compounds such as potassium bromide and sodium bromide, nitroindazole, nitrobenzimidazole, benzotriazole, benzothiazole, tetrazoles and thiazoles), chelating agents (e.g., ethylenediamine tetraacetic acid or alkali metal salts thereof, nitrilotriacetate, polyphosphates, etc.), development accelerating agents (e.g., the compounds as disclosed in U.S. Pat. No. 2,304,025, Japanese Patent Publication No. 45541/72, etc.), hardening agents (e.g., glutaraldehyde, etc.) or defoaming agents.

"Litho-type" development can be applied to the photographic emulsion of the present invention. "Litho-type" development means that development is infectiously carried out in the presence of a low concentration of sulfite ion, generally using dihydroxybenzenes as a developing agent, to photographically reproduce line images or half tone (dot) images (further details are disclosed in L. F. A. Mason, *Photographic Processing Chemistry,* pp. 163–165 (1966)). The "Litho-type" development involves the use of conventional materials at conventional conditions.

Conventional fixing solutions can be used. Fixing solutions are generally composed of fixing agents, hardening agents and other compositions having a pH of generally from 3.8 to 5.0. As fixing agents, there can be used thiosulfates such as sodium thiosulfate, potassium thiosulfate and ammonium thiosulfate, thiocyanates such as sodium thiocyanate, potassium thiocyanate and ammonium thiocyanate and other organic sulfur compounds capable of forming soluble and stable silver complex salts which are known as fixing agents.

Fixing solutions can include water soluble aluminum salts, such as aluminum chloride, aluminum sulfate and potassium alum as a hardening agent, if desired.

Conventional methods can be used to form dye images. A nega-posi method as disclosed in *Journal of the Society of Motion Picture and Television Engineers,* Vol. 61, pp. 677–701 (1953), and a color reversal method which comprises developing to form a negative silver image with a developing solution containing a black-and-white developing agent, conducting at least one uniform exposure or another suitable fogging treatment and subsequently color developing to form positive dye images, are employed.

Color developing solutions are generally composed of an aqueous alkaline solution containing a color developing agent. As color developing agents, conventionally known primary aromatic amine developing agents are used, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline and 4-amino-3-(β-methanesulfoamidoethyl)-N,N-diethylaniline. These are disclosed in L. F. A. Mason, *Photographic Processing Chemistry,* Focal Press, (1966), pp. 226–229, in U.S. Pat. Nos. 2,193,015, 2,592,364, and in Japanese Patent Application (OPI) No. 64933/73.

The photographic emulsion is bleached after color development. Bleaching can be performed per se or simultaneously with fixing (blixing). Conventional bleaching (or blixing) compositions are used at conventional conditions. As bleaching agents, there are polyvalent metallic compounds such as iron (III), cobalt (III), chromium (VI), copper (II), etc., ferricyanate or dichromate, salts of water soluble cobalt (III) or salts of water soluble copper (II) and a complex of an organic salt thereof, aminopolycarboxylic acids such as ethylenediamine tetraacetate, nitrilotriacetic acid, iminodiacetic acid, and N-hydroxyethylethylenediaminetriacetic acid, complex salts of malonic acid, tartaric acid, malic acid, diglycolid acid and dithioglycolic acid and a copper complex salt of 2,6-dipicolinic acid; peracids such as an alkyl peracid, a persulfate, a permanganate, hydrogen peroxide, a hypochlorite, water soluble quinones and nitrosophenol.

Into the processing solution, there can further be added not only bleaching accelerating agents as disclosed in U.S. Pat. Nos. 3,042,520 and 3,241,966 and in Japanese Patent Publications Nos. 8506/70 and 8836/70, but also various other conventional agents.

Having thus generally described the invention, the following Examples illustrate currently preferred modes of practicing the invention. The following Examples are not to be construed as limitative, unless otherwise indicated. In the Examples, all percentages, parts, and the like are by weight, unless otherwise indicated.

EXAMPLE 1

Silver halide grains were precipitated by a single jet method, physically ripened in a conventional manner, desalted and further chemically ripened to obtain a silver iodobromide emulsion (iodide content: 8 mol %). The average diameter of the silver halide grains contained in the emulsion was 0.7μ and 0.52 mol of silver halide was contained per kg of the emulsion.

1 kg of the emulsion was measured out, introduced into pots and dissolved in a constant temperature bath at 50° C. A methanol solution of the sensitizing dyes of the present invention as described in Table 1 was added thereto in a determined amount and mixed with stirring in the constant temperature bath at 40° C. 10 ml of a 1 wt % aqueous solution of 4-hydroxy-6-methyl-1,3,3a,7-tetrazaindene and 20 ml of a 1wt % aqueous solution of 2-hydroxy-4,6-dichlorotriazine sodium salt were added thereto with stirring. The thus prepared emulsion was coated on a cellulose triacetate film base to a dry thickness of 5μ and allowed to dry to obtain samples of light-sensitive materials. The film samples were cut into strips. One of the strips was exposed through an optical wedge to a sensitometer with a light source of a color temperature of 5400° K equipped with a red filter (SC-56) manufactured by Fuji Photo Film Co., Ltd. and with a Blue filter (Wratten 47B) manufactured by Eastman Kodak Co., Ltd., respectively. The exposure conditions were such that the illuminance was 256 lux and the exposure time was 1/20 second.

Another strip was exposed to obtain a spectrogram using a diffraction lattice type spectrophotometer equipped with a tungsten light source having a color temperature of 2666° K.

The exposed strips were developed with the following solution at 20° C. for 7 minutes, stopped, fixed and further washed with water to obtain a strip with black-and-white images. The red filter sensitivity ($S_R$) and the blue filter sensitivity ($S_B$) of the strips were measured by a P-type densitometer manufactured by Fuji Photo Film Co., Ltd. The standard point of optical density to determine sensitivity was (fog+0.20).

| Composition of the developing solution | |
|---|---|
| Water | 700 ml |
| Monomethylparaaminophenol (½ sulfate) | 2 g |
| Anhydrous sodium sulfite | 100 g |
| Hydroquinone | 5 g |
| Borax (pentahydrate) | 1.5 g |
| Water to make | 1 l |

The results are shown as relative values in Table 1.

TABLE 1

| Test No. | Sensitizing Dyes and Amounts Added per kg of Emulsion (× $10^{-5}$ mol) | | | | $S_R$ Relative Value | $S_B$ Relative Value | Fog |
|---|---|---|---|---|---|---|---|
| 1 | — | — | — | — | — | 100 | 0.04 |
| | (I-2) 4 | (II-2) 1 | (III-4) 8 | — | 224 | 92 | 0.05 |
| | (I-2) 6 | (II-2) 1 | (III-4) 8 | — | 232 | 92 | 0.05 |
| | (I-2) 8 | (II-2) 1 | (III-4) 8 | — | 232 | 89 | 0.05 |
| 2 | (I-1) 4 | (II-2) 1 | (III-7) 8 | — | 261 | 96 | 0.05 |
| | (I-1) 8 | (II-2) 1 | (III-7) 8 | — | 270 | 92 | 0.05 |
| 3 | (I-9) 4 | (II-4) 1 | (III-7) 8 | — | 237 | 92 | 0.05 |
| | (I-9) 8 | (II-4) 1 | (III-7) 8 | — | 253 | 92 | 0.05 |
| | (I-9) 12 | (II-4) 1 | (III-7) 8 | — | 270 | 86 | 0.05 |
| 4 | (I-2) 8 | (II-6) 1 | (III-6) 4 | — | 224 | 96 | 0.05 |
| | (I-2) 8 | (II-6) 1 | (III-6) 8 | — | 224 | 86 | 0.05 |
| 5 | (I-11) 4 | (II-3) 1 | (III-7) 8 | — | 253 | 92 | 0.05 |
| | (I-11) 8 | (II-3) 1 | (III-7) 8 | — | 265 | 92 | 0.05 |
| | (I-11) 12 | (II-3) 1 | (III-7) 8 | — | 265 | 86 | 0.06 |
| 6 | (I-1) 1 | — | — | For Comparison (A) 4 | 170 | 96 | 0.05 |
| | (I-1) 2 | — | — | (A) 4 | 182 | 96 | 0.05 |
| | (I-1) 4 | — | — | (A) 4 | 194 | 92 | 0.05 |
| 7 | (I-2) 4 | — | (III-4) 4 | — | 175 | 92 | 0.05 |
| | (I-2) 4 | — | (III-4) 8 | — | 198 | 86 | 0.05 |

The structure of the dye used for comparison was as follows.

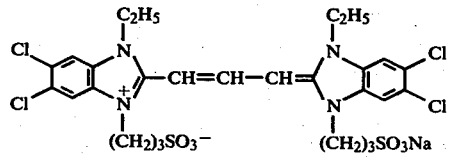

(A)

Table 1 shows the results wherein the sensitizing dyes of the present invention were used in the high sensitive silver iodobromide emulsion. Test No. 6 shows the results where dyes which are known to comparatively raise the sensitivity in the shorter wavelength of the red-sensitive region are used in combination (U.S. Pat. No. 3,873,324). Test No. 7 shows the results where dyes having a similar tendency to the above are used in combination (U.S. Pat. No. 3,679,428), i.e., a tendency to raise the sensitivity in the shorter wavelength of the red-sensitive region. However, the results where three dyes of the present invention were used in combination are superior.

EXAMPLE 2

80 g of 1-hydroxy-N-[γ-(2,4-di-tert-amylphenoxypropyl)]-2-naphthoamide was completely dissolved in a mixture of 100 ml of tricresyl phosphate and 50 ml of ethyl acetate. Then, 2 g of sorbitan monolaurate was dissolved therein. The resulting solution was added to 1 kg of a 10 wt % aqueous gelatin solution wherein an aqueous solution of 2.5 g of dodecylbenzenesulfonic acid had been added, stirred at high speed rate and emulsified by ultrasonic stirring to obtain emulsions. Necessary portions of 1 kg of silver iodobromide emulsion as prepared in the manner as shown in Example 1 were measured, introduced into a pot and dissolved in a constant temperature bath at 50° C.

Methanol solutions of the sensitizing dyes of the present invention and of the dyes for comparison as shown in Table 2 were respectively added in determined amounts and the system mixed, stirred and allowed to stand for 15 minutes. To the solutions were added 300 g of the dissolved emulsion, 10 ml of an aqueous solution of 1 wt % 4-hydroxy-6-methyl-1,3,3a,7-tetrazaindene, 10 ml of an aqueous solution of 1-hydroxy-3,5-dichlorotriazinesodium salt (1 wt %) and 10 ml of an aqueous solution of 1 wt % sodium dodecylbenzenesulfonate, and the resulting systems stirred.

The resulting emulsions were coated on a cellulose triacetate film base to a dry thickness of 5 microns and dried. A protective layer composed of gelatin was coated thereon to a dry thickness of 1 micron and dried. Then, the film sample was cut into strips. One of the strips was exposed through the optical wedge to the light senitometer (as described in Example 1) equipped with a red filter (SC-56 filter). Exposure was with an illuminance of 256 lux for 1/20 second. One set of samples which was allowed to stand at a temperature of 50° C. and at a relative humidity of 70% for 3 days. It was then tested to study the stability after the preparation of the light-sensitive materials with the passage of time; change was hardly detected. Another set of identical Samples was exposed by the above described spectrophotometer to obtain a spectrogram as described in Example 1.

These samples were developed at 38° C. by the following color negative developing processing.

| | |
|---|---|
| 1. Color development | 3 min. 15 sec. |
| 2. Bleaching | 6 min. 30 sec. |
| 3. Water washing | 3 min. 15 sec. |
| 4. Fixing | 6 min. 30 sec. |
| 5. Water washing | 3 min. 15 sec. |
| 6. Stabilizing bath | 3 min. 15 sec. |

Compositions of the treating solutions in each step was as follows.

| Color developing solution | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| N'-Ethyl-N'-(β-hydroxyethyl)-4-amino-2-methyl aniline sulfate | 4.5 g |
| Water to make | 1 l |
| **Bleaching solution** | |
| Ammonium bromide | 160.0 g |
| Aqueous ammonia (28 wt %) | 25.0 ml |
| Iron (III)-ethylenediamine tetraacetate sodium salt | 130.0 g |
| Glacial acetic acid | 14.0 ml |
| Water to make | 1 l |
| **Fixing solution** | |
| Polyphosphoric tetrasodium | 2.0 g |

-continued

| Color developing solution | |
|---|---|
| Sodium sulfite | 4.0 g |
| Ammonium thiosulfate (70 wt %) | 175.0 ml |
| Sodium bisulfite | 4.6 g |
| Water to make | 1 l |
| **Stabilizing solution** | |
| Formalin (40%) | 8.0 ml |
| Water to make | 1 l |

The density of the thus prepared strips was measured by a P-type densitometer manufactured by Fuji Photo Film Co., Ltd. to obtain relative sensitivities ($S_R$) and cyan color forming fog. The standard pint of the optical density to determine sensitivity was (fog+0.20). The results are shown as relative values in Table 2.

TABLE 2

| Test No. | Sensitizing Dyes and Amounts Added per kg of Emulsion ($\times 10^{-5}$ mol) | | | | $S_R$ Relative Value | Cyan Fog |
|---|---|---|---|---|---|---|
| 1 | — | — | — | — | — | 0.07 |
| | (I-4) 4 | (II-6) 1 | (III-1) 8 | — | 253 | 0.07 |
| | (I-4) 8 | (II-6) 1 | (III-1) 8 | — | 270 | 0.07 |
| | (I-4) 12 | (II-6) 1 | (III-1) 8 | — | 288 | 0.07 |
| 2 | (I-4) 8 | (II-7) 0.5 | (III-1) 8 | — | 279 | 0.07 |
| | (I-4) 8 | (II-7) 1 | (III-1) 8 | — | 288 | 0.07 |
| | (I-4) 8 | (II-7) 1 | (III-1) 4 | — | 288 | 0.07 |
| 3 | (I-2) 8 | (II-10) 1 | (III-2) 8 | — | 261 | 0.07 |
| | (I-2) 8 | (II-10) 2 | (III-2) 8 | — | 270 | 0.07 |
| 4 | (I-1) 8 | (II-2) 1 | (III-5) 8 | — | 270 | 0.07 |
| | (I-1) 8 | (II-2) 1 | (III-5) 12 | — | 288 | 0.08 |
| 5 | (I-7) 8 | (II-6) 1 | (III-5) 8 | — | 270 | 0.07 |
| | (I-7) 12 | (II-6) 1 | (III-5) 12 | — | 279 | 0.08 |
| 6 | (I-5) 8 | (II-7) 0.5 | (III-7) 4 | — | 275 | 0.07 |
| | (I-5) 8 | (II-7) 1 | (III-7) 4 | — | 284 | 0.07 |
| 7 | (I-4) 4 | — | (III-1) 4 | — | 199 | 0.07 |
| | (I-4) 4 | — | (III-1) 8 | — | 208 | 0.07 |
| 8 | (I-11) 8 | — | — | (I-4) 4 | 160 | 0.07 |
| | (I-11) 8 | — | — | (I-4) 8 | 175 | 0.07 |

Table 2 shows the results where color development was carried out using the sensitizing dyes of the present invention and cyan couplers. Test No. 7 shows the results where the combination of dyes described in U.S. Pat. No. 3,679,428 was used. Test No. 8 shows the results where the combination of dyes described in German Patent (OLS) No. 2,147,893 was used. Higher red sensitivities were obtained using the combination of dyes of the present invention.

EXAMPLE 3

Silver halide grains were precipitated by a double jet method, physically ripened in a conventional manner, desalted and chemically ripened in a conventional manner to obtain a silver chloroiodobromide emulsion (iodide content: 0.3 mol %, bromide content: 16.5 mol %). The average diameter of the silver halide grains contained therein was 0.4μ. The amount of silver halide contained therein was 1.15 mol per kg of the emulsion.

1 kg samples of the emulsion were measured out, introduced into pots, and dissolved in a constant temperature bath at 50° C. To the emulsion was added a methanol solution of the sensitizing dyes of the present invention in a determined amount as shown in Table 3 and the system mixed with stirring. Further, 20 ml of an aqueous solution of 4-hydroxy-6-methyl-1,3,3a,7-tetrazaindene (1 wt %), 10 ml of an aqueous solution of 1 wt % 2-hydroxy-4,6-dichlorotriazine sodium salt and 10 ml of an aqueous solution of 1 wt % sodium dodecylbenzenesulfonate were added thereto with stirring. The thus prepared emulsions were coated on a cellulose triacetate film base to a dry thickness of 5μ, followed by drying to obtain samples of light-sensitive materials. The film samples were cut into strips. One of the strips was exposed through an optical wedge to the same sensitometer as disclosed in Example 1, equipped with a red filter (Wratten No. 25) manufactured by Eastman Kodak Co., Ltd. Exposure was at an illuminance of 256 lux for 1/5 second. Another sample was exposed using the same diffraction lattice type spectrophotometer as disclosed in Example 1 to obtain a spectrogram.

The strips were developed with the developing solution having the following composition for 2 minutes at 20° C., stopped, fixed and washed with water to obtain strips having black-and-white images. The density of these strips were measured with the earlier described P-type densitometer to obtain the red sensitivity ($S_R$) thereof. The standard point of the optical densities to determine sensitivity was (fog+0.20).

| Composition of the developing solution | |
|---|---|
| Water | 500 ml |
| Monomethylparaaminophenol (½ sulfate) | 2 g |
| Sodium sulfite anhydride | 40 g |
| Hydroquinone | 4 g |
| Sodium carbonate (monohydrate) | 28 g |
| Potassium bromide | 1 g |
| Water to make | 1 l |

The solution was diluted with an equivalent volume of water for use. The results are shown as relative values in Table 3.

TABLE 3

| Test No. | Sensitizing Dyes and Amounts Added per kg of Emulsion (× $10^{-5}$ mol) | | | | $S_R$ Relative Value | Fog |
|---|---|---|---|---|---|---|
| 1 | — | — | — | — | — | 0.04 |
| | (I-4) 12 | (II-6) 4 | (III-1) 8 | — | 707 | 0.04 |
| | (I-4) 12 | (II-6) 4 | (III-1) 12 | | 725 | 0.04 |
| | (I-4) 12 | (II-6) 4 | (III-1) 16 | — | 725 | 0.04 |
| 2 | (I-4) 12 | (II-2) 2 | (III-2) 16 | — | 682 | 0.04 |
| | (I-4) 12 | (II-2) 4 | (III-2) 16 | — | 725 | 0.04 |
| | (I-4) 12 | (II-2) 8 | (III-2) 16 | — | 750 | 0.04 |
| 3 | (I-9) 3 | (II-6) 4 | (III-7) 16 | — | 707 | 0.04 |
| | (I-9) 6 | (II-6) 4 | (III-7) 16 | — | 750 | 0.04 |
| | (I-9) 12 | (II-6) 4 | (III-7) 16 | — | 725 | 0.04 |
| 4 | — | (II-6) 4 | — | For Comparison (B) 8 | 375 | 0.04 |
| | — | (II-6) 4 | — | (B) 16 | 392 | 0.04 |
| | — | (II-6) 8 | — | (B) 8 450 | 0.04 | |
| | — | (II-6) 8 | — | (B) 16 | 450 | 0.04 |

Dye B used for comparison has the following structure.

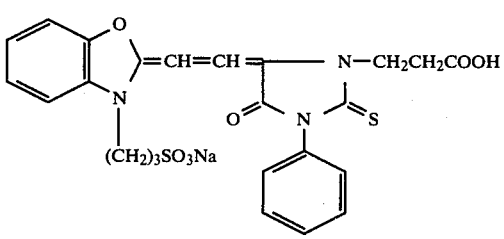

Table 3 shows examples where dyes of the present invention were used in a silver halide emulsion for lithography. Test No. 4 is a representative example of a conventional combination as disclosed in U.S. Pat. No. 3,808,009. It is apparent that the combination of dyes of the present invention provides a higher red sensitivity than that of comparison example.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion spectrally sensitized with a sensitizing combination of at least one sensitizing dye represented by General formula (I), at least one sensitizing dye represented by General formula (II), and at least one sensitizing dye represented by General formula (III):

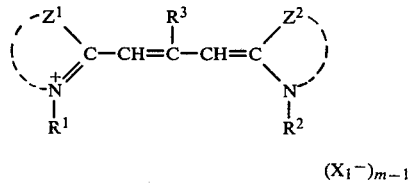

wherein $Z^1$ and $Z^2$ each is the atoms necessary to form a benzothiazole nucleus or a benzoselenazole nucleus, $R^1$ and $R^2$ each is an alkyl group or a substituted alkyl group wherein the substituted alkyl group is a substituted alkyl group having a sulfo group, a carboxy group, a hydroxy group, an allyl group or a benzyl group, and wherein at least one of $R^1$ and $R^2$ is a substituted alkyl group having a sulfo group, $R^3$ is an alkyl group, $X_1$ is an acid anion and m is 1 or 2, and when the dye forms an intermolecular salt (betaine like structure), m is 1;

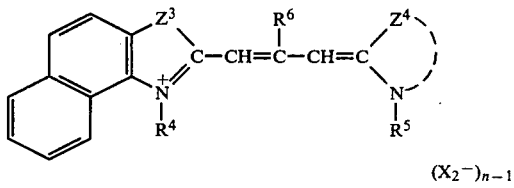

wherein $Z^3$ is a sulfur atom or a selenium atom, $Z^4$ is the atoms necessary to form a benzothiazole nucleus, a benzoselenazole nucleus, a naphtho[1,2-d]thiazole nucleus or a naphtho[1,2-d]selenazole nucleus, $R^4$ and $R^5$ each is an alkyl group or a substituted alkyl group as defined for $R^1$ and $R^2$, wherein at least one of $R^4$ and $R^5$ is a substituted alkyl group having a sulfo group, $R^6$ is an alkyl group, an aryl group, a furyl group or a thienyl group, $X^2$ is an acid anion and n is 1 or 2, and n is 1 when the dye forms an intermolecular salt (betaine like structure);

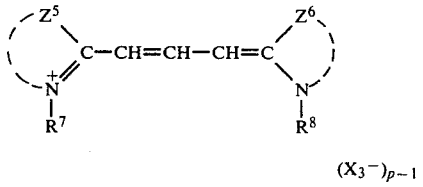

wherein $Z^5$ is the atomic group necessary to complete a naphthothiazole nucleus, $Z^6$ is the atomic group necessary to complete a benzimidazole nucleus, $R^7$ and $R^8$ each is an alkyl group or a substituted alkyl group as defined for $R^1$ and $R^2$ where at least one of $R^7$ and $R^8$ is a carboxyalkyl group or a substituted alkyl group having a sulfo group, $X_3$ is an acid anion, and p is 1 or 2, and p is 1 when the dye forms an intermolecular salt.

2. The emulsion of claim 1, wherein the dyes represented by General formulae (I), (II) and (III) are present in an amount of from about $1\times10^{-6}$ mol to about $5\times10^{-3}$ mol per mol of silver halide, this range applying to each class of dyes of General formulae (I), (II) and (III).

3. The emulsion of claim 1, wherein the ratio of each of the dyes of the General formulae is, expressed as a molar ratio of the amount of dye(s) represented by General formula (I): the amount of dye(s) represented by General formula (II): the amount of dye(s) represented by General formula (III), 1–20:1:2–20.

4. The emulsion of claim 3, wherein said molar ratio is, same basis: 10–16:1:4–10.

5. The emulsion of claim 3, wherein $R^1$ and $R^2$, $R^4$ and $R^5$, $R^7$ and $R^8$, when an alkyl group or a substituted alkyl group, have 1 to 6 carbon atoms in the alkyl group or alkyl moiety thereof.

6. The emulsion of claim 5, wherein $R^1$, $R^2$, $R^4$ and $R^5$, when a substituted alkyl group, have as a substituent a sulfo group or a carboxy group, and $R^7$ and $R^8$, when a substituted alkyl group, are substituted with a sulfo group or a carboxy group.

7. The emulsion of claim 1, wherein said substituted alkyl group is a substituted alkyl group having a sulfo group.

8. The emulsion of claim 1, wherein said substituted alkyl group is a substituted alkyl group having a carboxyalkyl group.

9. The emulsion of claim 1, wherein said substituted alkyl group is a substituted alkyl group having a hydroxyalkyl group.

10. The emulsion of claim 1, wherein said substituted alkyl group is a substituted alkyl group having an allyl group.

11. The emulsion of claim 1, wherein said substituted alkyl group is a substituted alkyl group having a benzyl group.

12. A photographic silver halide emulsion spectrally sensitized with a sensitizing combination of at least one sensitizing dye represented by formula (I), at least one sensitizing dye represented by formula (II), and at least one sensitizing dye represented by formula (III):

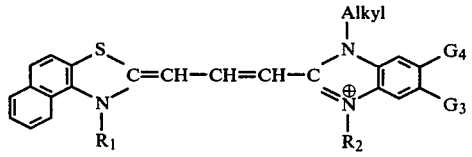

(I)

wherein $G_3$ and $G_4$ each is halogen and $R_1$ and $R_2$ each is sulfoalkyl;

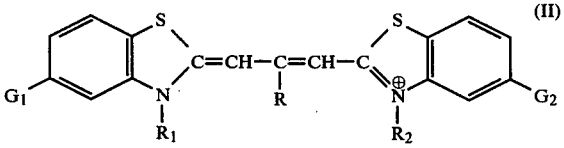

(II)

wherein R is alkyl, $R_1$ and $R_2$ each is sulfoalkyl, and $G_1$ and $G_2$ each is halogen, alkyl, aryl or alkoxy;

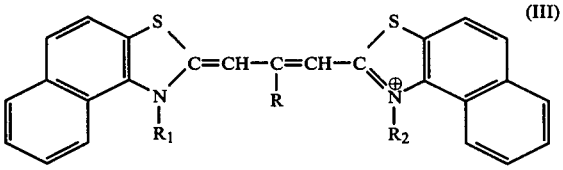

(III)

wherein R is alkyl and $R_1$ and $R_2$ each is sulfoalkyl.

* * * * *